US008684222B2

(12) United States Patent
Tesink et al.

(10) Patent No.: US 8,684,222 B2
(45) Date of Patent: Apr. 1, 2014

(54) TRAY, IN PARTICULAR FOR CATERING PURPOSES ONBOARD AIRCRAFTS

(71) Applicant: deSter Holding B.V., Amsterdam (NL)

(72) Inventors: Ton Tesink, Venlo (NL); Ruud Vanderheyden, Lokeren (BE)

(73) Assignee: deSter Holding B.V., Amsterdam (NL)

( * ) Notice: Subject to any disclaimer, the term of this patent is extended or adjusted under 35 U.S.C. 154(b) by 0 days.

(21) Appl. No.: 13/722,770

(22) Filed: Dec. 20, 2012

(65) Prior Publication Data

US 2013/0134158 A1 May 30, 2013

Related U.S. Application Data

(63) Continuation of application No. 13/036,965, filed on Feb. 28, 2011, now abandoned, which is a continuation of application No. PCT/EP2009/001506, filed on Mar. 4, 2009.

(30) Foreign Application Priority Data

Aug. 28, 2008 (DE) ..... 20 2008 011 452 U

(51) Int. Cl.
*A47G 19/00* (2006.01)

(52) U.S. Cl.
USPC ..... 220/575; 220/23.4; 206/557; 206/558; 206/561; 206/564; 294/172

(58) Field of Classification Search
USPC ..... 220/23.6, 23.83, 555, 575, 23.4; 206/501, 557, 558, 561, 564; 294/172
See application file for complete search history.

(56) References Cited

U.S. PATENT DOCUMENTS

| | | | |
|---|---|---|---|
| 2,328,689 | A | 9/1943 | Rutherford |
| 2,828,059 | A | 3/1958 | Ross |
| 3,811,566 | A | 5/1974 | Bateman |
| 4,279,354 | A | 7/1981 | Conti |

(Continued)

FOREIGN PATENT DOCUMENTS

| | | | |
|---|---|---|---|
| AT | 384 355 | B | 11/1987 |
| DE | 202 01 817 | U1 | 6/2002 |

(Continued)

OTHER PUBLICATIONS

PCT Notification of Transmittal of International Search Report and the Written Opinion of PCT/EP2009/001506, filed Mar. 4, 2009 (3 pgs.), dated May 5, 2009.

(Continued)

*Primary Examiner* — Anthony Stashick
*Assistant Examiner* — Elizabeth Volz
(74) *Attorney, Agent, or Firm* — Shlesinger, Arkwright & Garvey LLP

(57) ABSTRACT

A tray, in particular for catering purposes onboard aircrafts, including a tray body defining a receiving surface for receiving thereon items to be carried by use of the tray. The tray body includes an interlocking device for releasably engaging an interlocking device of the tray body of a similar tray, when at least two trays are positioned such that the receiving surfaces of the tray bodies are overlapping each other partially. The interlocking device of the trays interacting such that when one of the trays is drawn in a drawing direction, the other tray is moved along in the drawing direction.

4 Claims, 1 Drawing Sheet

(56) References Cited

U.S. PATENT DOCUMENTS

| | | | | |
|---|---|---|---|---|
| 4,293,071 | A | 10/1981 | Bridges | |
| 6,315,126 | B1 | 11/2001 | Cornelissen | |
| 2006/0186186 | A1 | 8/2006 | Kuhn et al. | |
| 2007/0209962 | A1 * | 9/2007 | Fransen | 206/555 |
| 2008/0202976 | A1 * | 8/2008 | Burgess et al. | 206/558 |

FOREIGN PATENT DOCUMENTS

| | | | |
|---|---|---|---|
| EP | 0 987 972 | B1 | 11/2002 |
| FR | 2 411 091 | | 7/1979 |
| GB | 1 337 982 | | 11/1973 |
| NL | 6 612 391 | | 3/1968 |
| WO | 04/000689 | A1 | 12/2003 |
| WO | 2004/085285 | A1 | 10/2004 |

OTHER PUBLICATIONS

PCT Written Opinion of PCT/EP2009/001506, filed Mar. 4, 2009 (5 pgs.), dated May 5, 2009.

Office Action from European application No. EP 09 776 408.8 (4 pgs.).

U.S. Appl. No. 13/036,965, filed Feb. 2011, Tesink et al.

* cited by examiner

TRAY, IN PARTICULAR FOR CATERING PURPOSES ONBOARD AIRCRAFTS

CROSS-REFERENCE TO RELATED APPLICATIONS

This application is a continuation of application Ser. No. 13/036,965, filed Feb. 28, 2011, which application Ser. No. 13/036,965 is a continuation of PCT/EP2009/001506, filed Mar. 4, 2009, which application no. PCT/EP2009/001506 claims the priority of German application no. 20 2008 011 452.7, filed Aug. 28, 2008, and each of which is incorporated herein by reference.

FIELD OF THE INVENTION

The invention relates to a tray, for catering purposes onboard aircrafts. In particular, the invention relates to a tray including a tray body defining a receiving surface for receiving thereon items to be carried by the tray for catering purposes onboard aircrafts.

BACKGROUND OF THE INVENTION

Trays of this kind are well known, for example from EP 0 987 972 B1, and include a tray body defining a receiving surface for receiving thereon items to be carried by use of the tray. Usually, catering articles, for example dishes, cups, cutlery and foodstuff items are received on the receiving surface. If a hot meal is to be served to a passenger, the tray is drawn out of a storing trolley. Then a separate container containing the hot meal is placed on the tray which then is served to a passenger. It is a disadvantage of the known trays that they require a substantial amount of space when stored in a trolley. This disadvantage is even more important since the storing space in a trolley onboard aircrafts is very limited.

OBJECTS AND SUMMARY OF THE INVENTION

It is an object of the present invention to provide a tray which may be stored in a more space-saving manner in a trolley.

This object is achieved by the invention which includes a tray for catering purposes onboard aircrafts, the tray including a tray body defining a receiving surface for receiving thereon items to be carried by the tray. The tray body includes an interlocking device configured for releasably engaging an interlocking device of the tray body of a similar tray, when at least two trays are positioned such that the receiving surfaces of the tray bodies are overlapping each other partially, and the interlocking devices of the at least two trays interact such that when one of the at least two trays is drawn in a drawing direction, the other one of the at least two trays is moved along in the drawing direction.

It is a basic idea of the invention to construct the tray such that similar trays may be stored in a trolley with their receiving surfaces overlapping each other partially. In order to simplify the handling of the trays, the tray according to the invention includes an interlocking device for releasably engaging an interlocking device of the tray body of a similar tray, wherein at least two trays are positioned such that the receiving surfaces of the tray bodies are overlapping each other. The interlocking devices of the trays are interacting such that when one of the trays is drawn in a drawing direction, the other tray is moved along in the drawing direction. In this way, drawing the trays for example out of a trolley is simplified. After drawing a tray out of the trolley, a container containing a hot meal may be placed on the receiving surface, namely in an area, in which the trays were overlapping in their storing position. Consequently, the trays according to the invention may be stored in a highly space-saving manner without restricting the size of the receiving surface. That is, the first interlocking device is configured for releasably engaging the second interlocking device of the second tray body of the second tray, when at least the first tray and the second tray are positioned such that the first receiving surface of the first tray body is partially overlapping the second receiving surface of the second tray body, and the first and second interlocking devices of the first and second trays interacting such that when one of the first tray and the second tray is drawn in a drawing direction, the other one of the first tray and second tray is moved along in the drawing direction. The first interlocking device includes a first substantially form-locking element, and the second interlocking device includes a second substantially form-locking element, the second interlocking device including at least a second protrusion located on an upper surface of the second tray body and a further second protrusion defining at least a second recess located on a lower surface of the second tray body. The first interlocking device includes at least a first protrusion located on an upper surface of the first tray body and a further first protrusion defining at least a first recess located on a lower surface of the first tray body, and the at least a first protrusion engaging the at least a second recess of the second, similar tray, when the first and second tray bodies of the first and second trays are overlapping each other. The overlapping part of the first receiving surface of the first tray body extends between the at least a first protrusion and the further protrusion defining the first recess. The overlapping part of the second receiving surface of the second tray body extends between an upwardly extending free end of the second body and the further protrusion defining the at least a second recess located on the lower surface of the second tray body.

The tray according to the invention is particularly useful for catering purposes onboard aircrafts.

According to a preferred embodiment of the invention, the interlocking device includes a substantially form-locking device.

In order to keep the tray body as simple as possible in order to have it manufactured at low costs, it is preferred that the interlocking device includes at least one protrusion located on the upper surface of the tray body and at least one recess located on the lower surface of the tray body, the protrusion engaging the recess of a similar tray, when the tray bodies of two similar trays are overlapping each other. Basically, according to the invention, one protrusion and one recess are sufficient. However, according to the respective requirements a plurality of protrusions and corresponding recesses may be provided. Furthermore, preferably the protrusion is integral with the tray body.

In order to keep the tray body particularly simple and lightweight, it is preferred that the tray body has a shaped-cross section, the shaped-cross section forming the protrusion and the recess.

According to a further preferred embodiment, the protrusion and the recess at least sectionally are shaped substantially complementary to the each other. Basically, the protrusion and the recess may be shaped in an arbitrary way as long as the interlocking function is maintained. However, according to a further preferred embodiment the protrusion and the recess have a substantially triangular cross section.

In order to render the tray body particularly lightweight, it is preferred that the protrusion and the recess are formed by hollow sections of the shaped cross-section.

According to the respective requirements the tray body may be manufactured from arbitrary materials. In order to have the tray manufactured at particularly low costs, it is preferred that the tray body is manufactured from plastics.

According to another preferred embodiment, the invention includes at least two trays being configured for being releasably interlocked when received on a tray storing trolley for catering purposes onboard aircrafts, comprising that:

a) the at least two trays includes a first tray and a second, similar tray;

b) the first tray includes a first tray body defining a first receiving surface for receiving thereon items to be carried by the first tray;

c) the second tray includes a second tray body defining a second receiving surface for receiving thereon items to be carried by the second tray;

d) the second tray includes a second interlocking device configured for releasably engaging a first interlocking device of the first tray body of the first tray;

e) the first tray body includes a first interlocking device configured for releasably engaging the second interlocking device of the second tray body of the second tray, when at least the first tray and the second tray are positioned such that the first receiving surface of the first tray body is partially overlapping the second receiving surface of the second tray body, and the first and second interlocking devices of the first and second trays interacting such that when one of the first tray and the second tray is drawn in a drawing direction, the other one of the first tray and second tray is moved along in the drawing direction;

f) the first interlocking device includes a first substantially form-locking element;

g) the second interlocking device includes a second substantially form-locking element, the second interlocking device including at least a second protrusion located on an upper surface of the second tray body and at least a second recess located on a lower surface of the second tray body;

h) the first interlocking device includes at least a first protrusion located on an upper surface of the first tray body and at least a first recess located on a lower surface of the first tray body, and the at least a first protrusion engaging the at least a second recess of the second, similar tray, when the first and second tray bodies of the first and second trays are overlapping each other;

i) the first and second tray bodies being manufactured from plastics; and j) the first and second tray bodies being a one-piece structure.

The invention will now be explained in greater detail with reference to the attached drawings, wherein all features described, shown in the drawings and claimed in the claims constitute the subject matter of the invention, either taken alone or in arbitrary combination with each other, regardless of their particular description and particular illustration in the drawings as well as regardless of their combination in the claims and the dependencies of the claims.

Relative terms, such as left, right, up, and down are not intended to be limiting.

DETAILED DESCRIPTION OF THE INVENTION

Figure 1:
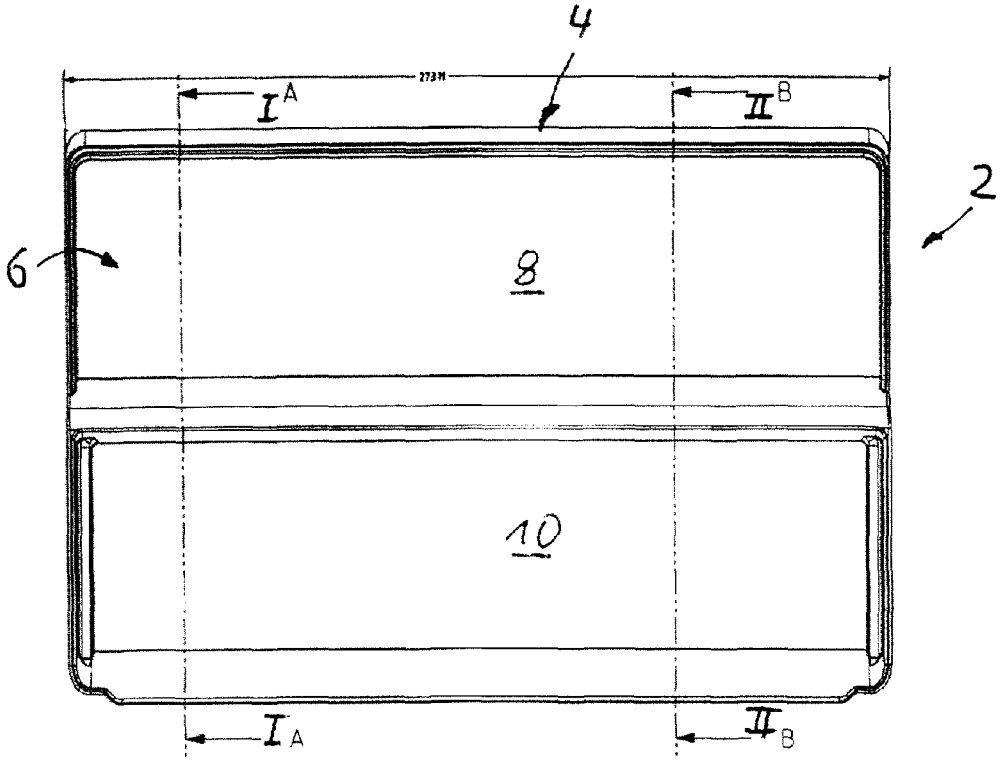
FIG. 1 shows a plan view of an embodiment of a tray according to the invention.

FIG. 1 shows a tray 2 according to the invention, in particular for catering purposes onboard aircrafts including a tray body 4 for defining a receiving surface 6 for receiving thereon items to be carried by use of the tray, e.g. dishes, cups, food container, cutlery or foodstuff items. In the illustrated embodiment, the tray body 4 is substantially flat and is manufactured from plastics. The tray body 4 is a one-piece structure, as shown, and as will be readily understood by a person having ordinary skill in the art.

Figure 2:
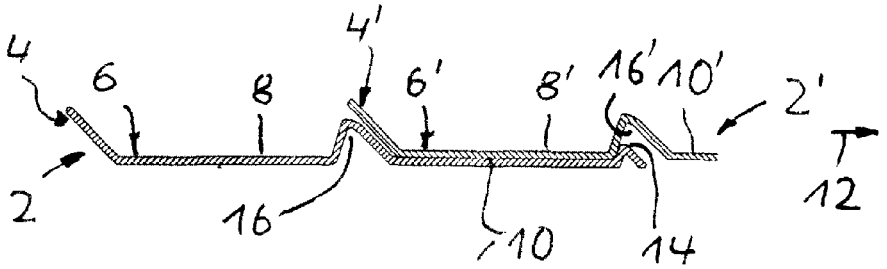
FIG. 2 shows a section along a line I-I in FIG. 1.

FIG. 2 shows a cross-section along a line I-I in FIG. 1, wherein the tray 2 is shown together with a similar tray 2'. For parts of the tray 2' corresponding to parts of the tray 2 corresponding reference numerals are used.

The trays 2, 2', which may be designated first tray 2 and second tray 2', respectively, are shown in a position in which the receiving surfaces 6, 6' of the tray bodies 4, 4' are overlapping each other partially.

The receiving surfaces 6, 6' may likewise be designated first receiving surface 6 and second receiving surface 6', respectively. Tray bodies 4, 4', may be designated first tray body 4 and second tray body 4', respectively.

As can be seen in FIG. 1, the receiving surface 6 of the tray 2 is divided into two sections 8, 10. In the position shown in FIG. 2, the section 8' of the receiving surface 6' of the tray 2' is overlapping the section 10 of the receiving surface 6 of the tray 2 such that the section 10 of the receiving surface 6 of the tray 2 is covered.

Since both trays 2, 2' have an identical structure, in the following only the tray 2 will be explained in greater detail.

According to the invention the tray body 4 includes a first interlocking device for releasably engaging an interlocking device, which may be termed a second interlocking device, of the tray body 4' of a similar tray 2', when at least two trays 2, 2' are positioned such that the first and second respective receiving surfaces 6, 6' are overlapping each other partially, as shown in FIG. 1. Furthermore, according to the invention the interlocking devices of the trays 2, 2' are interacting such that when one of the trays, e.g. the tray 2', is drawn in a drawing direction symbolized by an arrow 12 in FIG. 2, the other tray 2 is moved along in the drawing direction 12.

In the illustrated embodiment the interlocking device includes substantially a form locking device. In particular, in the illustrated embodiment the interlocking device includes a protrusion 14 located on the other surface of the tray body 4 and a recess 16 located on the lower surface of the tray body 4, the protrusion 14 engaging the recess 16' of the tray 2', when the tray bodies 4, 4' of the two trays 2, 2' are overlapping each other, is shown in FIG. 2.

As can be seen from FIG. 2, in the illustrated embodiment the tray body 4 has a shaped cross-section, the shaped cross-section forming the protrusion 14 and the recess 16, wherein the protrusion 14 and the recess 16 at least sectionally are shaped substantially complementary to each other. In particular, in the illustrated embodiment, the protrusion 14 and the recess 16 have a substantially triangular cross section and are formed by hollow sections of the shaped cross-section.

In use, the trays 2, 2' are stored in a trolley onboard aircrafts in the position shown in FIG. 2, in which the receiving surfaces 6, 6' of the trays 2, 2' are overlapping each other. In this storing position, catering articles and/or foodstuff items may be received on the sections 8, 8' of the receiving surfaces 6, 6'. In order to serve the tray 2, 2' to a passenger, the tray 2' is drawn in the drawing direction 12. Since the trays 2, 2' are releasably interlocked by the interlocking device, the tray 2 is moved along with the tray 2' in the drawing direction 12.

In order to separate the tray 2' from the tray 2, the recess 16' may be lifted over the protrusion 14 such that the trays 2, 2' are disengaged from each other. In this position, the section 10 of the receiving surface 6 of the tray 2 is no longer covered by the tray 2'. Therefore, e.g. a container containing a hot meal may be placed on the section 10, and the tray 2 may then be served to the passenger.

According to the invention, the trays 2, 2' may be stored in a highly space-saving manner in a trolley without restricting the size of the receiving surface 6.

Figure 3:
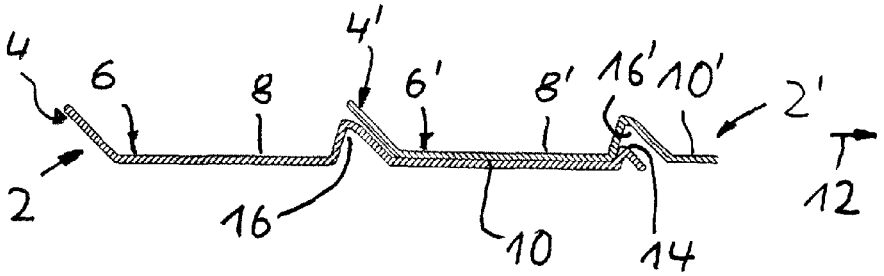
FIG. 3 shows a section along a line II-II in FIG. 1.

From FIG. 3 showing a section along the line II-II in FIG. 1, it can be seen that spaced from their rims the trays 2, 2' have the same cross-section along their width.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. At least two trays, the at least two trays being configured for being releasably interlocked when received on a tray storing trolley for catering purposes onboard aircrafts, comprising:

a) the at least two trays including a first tray and a second, similar tray;

b) the first tray including a first tray body defining a first receiving surface for receiving thereon items to be carried by the first tray, and the first tray body including a first interlocking device;

c) the second tray including a second tray body defining a second receiving surface for receiving thereon items to be carried by the second tray;

d) the second tray including a second interlocking device configured for releasably engaging the first interlocking device of the first tray body of the first tray;

e) the first interlocking device being configured for releasably engaging the second interlocking device of the second tray body of the second tray, when at least the first tray and the second tray are positioned such that the first receiving surface of the first tray body is partially overlapping the second receiving surface of the second tray body, and the first and second interlocking devices of the first and second trays interacting such that when one of the first tray and the second tray is drawn in a drawing direction, the other one of the first tray and second tray is moved along in the drawing direction;

f) the first interlocking device including a first substantially form-locking element;

g) the second interlocking device including a second substantially form-locking element, the second interlocking device including at least a second protrusion located on an upper surface of the second tray body and a further second protrusion defining at least a second recess located on a lower surface of the second tray body;

h) the first interlocking device including at least a first protrusion located on an upper surface of the first tray body and a further first protrusion defining at least a first recess located on a lower surface of the first tray body, and the at least a first protrusion engaging the at least a second recess of the second, similar tray, when the first and second tray bodies of the first and second trays are overlapping each other;

i) an overlapping part of the first receiving surface of the first tray body extending between the at least a first protrusion and the further protrusion defining the first recess;

j) an overlapping part of the second receiving surface of the second tray body extending between an upwardly extending free end of the second body and the further protrusion defining the at least a second recess located on the lower surface of the second tray body;

k) the first and second tray bodies being manufactured from plastics; and l) the first and second tray bodies being a one-piece structure.

2. At least two trays as claimed in claim 1, wherein:

a) the at least a first protrusion and the at least a first recess are shaped substantially complementary to each other; and b) the at least a second protrusion and the at least a second recess are shaped substantially complementary to each other.

3. At least two trays as claimed in claim 1, wherein:

a) the at least a first protrusion and the at least a first recess have a substantially triangular cross-section; and b) the at least a second protrusion and the at least a second recess have a substantially triangular cross-section.

4. At least two trays as claimed in claim 1, wherein:

a) the at least a first protrusion is hollow; and b) the at least a second protrusion is hollow.

* * * * *